US010674281B2

(12) United States Patent
Kim et al.

(10) Patent No.: US 10,674,281 B2
(45) Date of Patent: Jun. 2, 2020

(54) FILM SPEAKER AND DISPLAY DEVICE INCLUDING THE SAME

(71) Applicant: LG DISPLAY CO., LTD., Seoul (KR)

(72) Inventors: Taeheon Kim, Seoul (KR); Chiwan Kim, Goyang-si (KR); Sung-Eui Shin, Seoul (KR); YongWoo Lee, Goyang-si (KR); Kyungyeol Ryu, Goyang-si (KR); YuSeon Kho, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/029,209

(22) Filed: Jul. 6, 2018

(65) Prior Publication Data

US 2019/0014420 A1 Jan. 10, 2019

(30) Foreign Application Priority Data

Jul. 7, 2017 (KR) ..... 10-2017-0086363

(51) Int. Cl.

| | |
|---|---|
| ***H04R 19/02*** | (2006.01) |
| ***H04R 1/02*** | (2006.01) |
| ***H04R 9/06*** | (2006.01) |
| ***H04R 9/02*** | (2006.01) |

(52) U.S. Cl.

CPC ..... *H04R 19/02* (2013.01); *H04R 1/028* (2013.01); *H04R 2499/15* (2013.01)

(58) Field of Classification Search

None

See application file for complete search history.

(56) References Cited

U.S. PATENT DOCUMENTS

| | | | | |
|---|---|---|---|---|
| 8,861,755 | B2 * | 10/2014 | Ando | H04R 17/005 381/190 |
| 8,976,997 | B1 * | 3/2015 | Hecht | H04R 19/02 381/152 |
| 9,070,861 | B2 | 6/2015 | Bibl et al. | |
| 2004/0052387 | A1 * | 3/2004 | Norris | H04R 1/403 381/190 |
| 2006/0066589 | A1 * | 3/2006 | Ozawa | G06F 3/0414 345/173 |
| 2007/0019134 | A1 * | 1/2007 | Park | G02F 1/133 349/96 |
| 2007/0046642 | A1 * | 3/2007 | Lee | G06F 3/045 345/173 |
| 2009/0160813 | A1 * | 6/2009 | Takashima | G06F 3/016 345/173 |

(Continued)

FOREIGN PATENT DOCUMENTS

| | | | |
|---|---|---|---|
| CN | 1812661 | A | 8/2006 |
| CN | 102916033 | A | 2/2013 |

(Continued)

*Primary Examiner* — Qin Zhu

(74) *Attorney, Agent, or Firm* — Birch, Stewart, Kolasch & Birch, LLP

(57) ABSTRACT

Discussed are a film speaker and a display device. The film speaker includes an electroactive layer including a first surface and a second surface opposite to the first surface, and further including a plurality of concave portions; and a first electrode and a second electrode disposed on at least one of the first surface and the second surface. Therefore, the sound generated in the film speaker may be further amplified and the sound pressure level may be improved.

20 Claims, 12 Drawing Sheets

(56) References Cited

U.S. PATENT DOCUMENTS

| | | | | |
|---|---|---|---|---|
| 2009/0285431 | A1* | 11/2009 | Carlson | H04R 1/028 381/345 |
| 2011/0102385 | A1* | 5/2011 | Jung | G02F 1/13452 345/204 |
| 2011/0128245 | A1* | 6/2011 | Andoh | H01L 41/193 345/173 |
| 2011/0157058 | A1* | 6/2011 | Bita | G02B 6/0055 345/173 |
| 2013/0034685 | A1 | 2/2013 | An et al. | |
| 2013/0108087 | A1* | 5/2013 | Takano | H04R 19/02 381/191 |
| 2013/0223656 | A1* | 8/2013 | Iuchi | H04R 1/023 381/189 |
| 2014/0233768 | A1* | 8/2014 | Hirayama | G10K 9/125 381/190 |
| 2014/0300528 | A1* | 10/2014 | Ebisui | G02B 27/2214 345/32 |
| 2016/0008852 | A1* | 1/2016 | Miyoshi | H01L 41/0475 359/444 |
| 2016/0014527 | A1* | 1/2016 | Miyoshi | H04R 17/005 381/190 |
| 2018/0014096 | A1* | 1/2018 | Miyoshi | H04R 1/02 |
| 2018/0160248 | A1* | 6/2018 | Murakami | H04R 17/005 |
| 2018/0229271 | A1* | 8/2018 | Inoue | H04R 1/02 |

FOREIGN PATENT DOCUMENTS

| | | | |
|---|---|---|---|
| CN | 106269451 | A | 1/2017 |
| CN | 206077677 | U | 4/2017 |
| CN | 206077678 | U | 4/2017 |
| KR | 10-2007-0027879 | A | 3/2007 |
| KR | 10-1739335 | B1 | 5/2017 |

* cited by examiner

FILM SPEAKER AND DISPLAY DEVICE INCLUDING THE SAME

CROSS-REFERENCE TO RELATED APPLICATION

This application claims the priority of Korean Patent Application No. 10-2017-0086363 filed on Jul. 7, 2017, in the Korean Intellectual Property Office, the disclosure of which is incorporated herein by reference.

BACKGROUND OF THE INVENTION

Field of the Invention

The present disclosure relates to a film speaker and a display device including the same, and more particularly, to a film speaker which is capable of being applied to a flexible display device and has an improved sound pressure level (SPL) and a display device including the same.

Description of the Related Art

A voice coil diaphragm speaker of the related art is operated by a principle of attaching a voice coil motor which is a magnet covered by a coil on a rear surface of a panel to vibrate the panel by vibrating the motor. A speaker of the related art has a limitation in weight reduction due to presence of a motor and has a problem in that it is difficult to implement a bendable or transparent speaker. Further, when the speaker is coupled to the display panel functioning as a screen, the thickness of the display panel may be excessively increased and the speaker cannot be applied to the flexible display device. Further, since the voice coil diaphragm type speaker is opaque, there is a limitation in that the speaker needs to be inevitably disposed only in the rear surface of the display panel.

Therefore, there are demands for a thin film type speaker as thin as a sheet of paper, instead of a voice coil diaphragm type speaker, and for a transparent film type speaker which also can be applied to a flexible display device.

SUMMARY OF THE INVENTION

An object to be achieved by the present disclosure is to provide a film speaker and a display device including the same in which a concave shape is formed on a surface to effectively amplify sounds generated from the film speaker.

Another object to be achieved by the present disclosure is to provide a film speaker and a display device including the same in which a concave shape having a circular or polygonal cross-section is formed on a surface of the film speaker to improve a sound pressure level.

Objects of the present disclosure are not limited to the above-mentioned objects, and other objects, which are not mentioned above, can be clearly understood by those skilled in the art from the following descriptions.

According to an aspect of the present disclosure, a film speaker includes an electroactive layer having a first surface and a second surface opposite to the first surface, and including a plurality of concave portions, and a first electrode and a second electrode disposed on at least one of the first surface and the second surface of the electroactive layer. Therefore, it is possible to implement a transparent and flexible film speaker with a further amplified sound.

According to another aspect of the present disclosure, a display device includes a film speaker and a display panel disposed on a first surface of the film speaker to display images in which the film speaker includes an electroactive layer having a first surface and a second surface opposite to the first surface, and having a plurality of concave and convex structures disposed on at least one of the first surface and the second surface of the electroactive layer, and a first electrode and a second electrode disposed on at least one of the first surface and the second surface of the electroactive layer. Therefore, it is possible to implement a display device with a further improved sound pressure level.

According to another aspect of the present disclosure, a film speaker includes an electroactive layer including a plurality of concave portions on a surface of the electroactive layer; and an electrode disposed on the surface, and inside the plurality of concave portions.

Other detailed matters of the embodiments are included in the detailed description and the drawings.

According to the present disclosure, a transparent and flexible film speaker using an electroactive layer may be provided.

Further, according to the present disclosure, an electroactive layer has a plurality of concave portions to further amplify sounds generated from the film speaker.

Furthermore, according to the present disclosure, a shape of a concave and convex structure of an electroactive layer is optimized to optimize the amplification of the sound of the film speaker and improve a sound pressure level.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
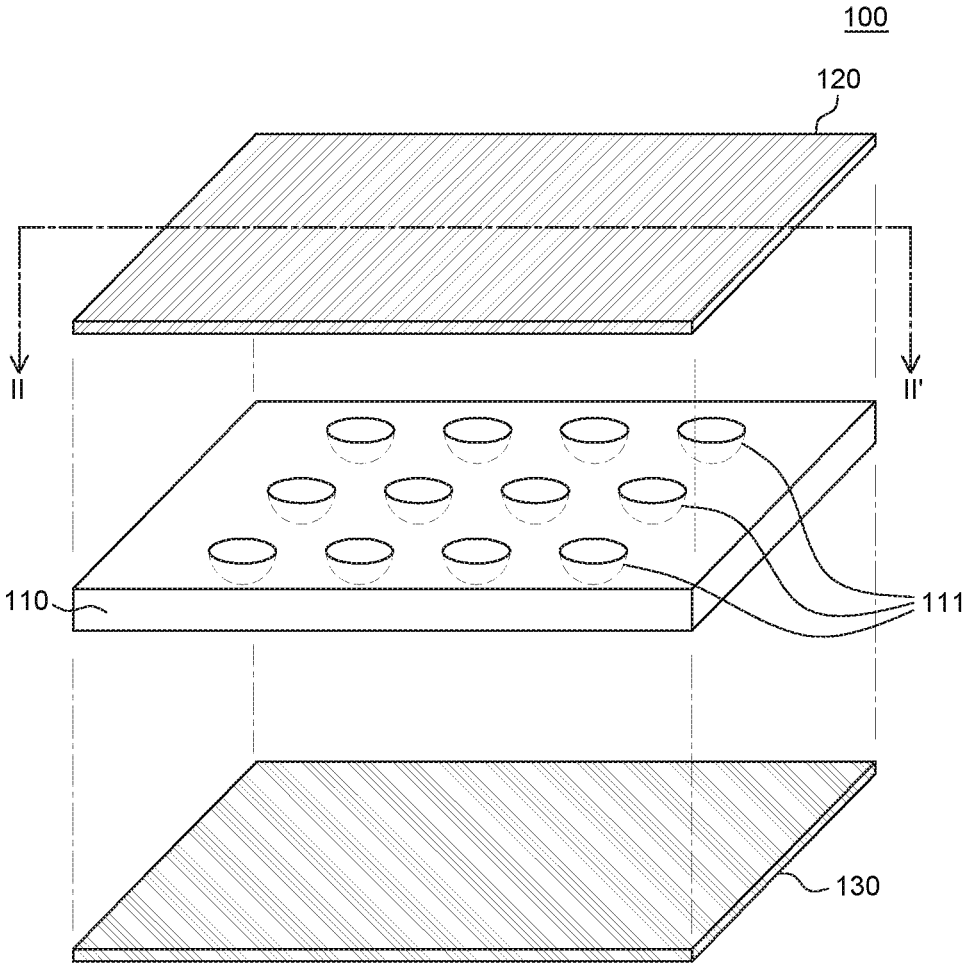
FIG. 1 is an exploded perspective view of a film speaker according to an example embodiment of the present disclosure.

Advantages and characteristics of the present disclosure and a method of achieving the advantages and characteristics will be clear by referring to example embodiments described below in detail together with the accompanying drawings. However, the present disclosure is not limited to the example embodiments disclosed herein but will be implemented in various forms. The example embodiments are provided by way of example only so that a person of ordinary skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the example embodiments of the present disclosure are merely examples, and the present disclosure is not limited thereto. Like reference numerals generally denote like elements throughout the specification. Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly" is not used.

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for the convenience of description, and the present disclosure is not limited to the size and the thickness of the component illustrated.

The features of various embodiments of the present disclosure can be partially or entirely bonded to or combined with each other and can be interlocked and operated in technically various ways understood by those skilled in the art, and the embodiments can be carried out independently of or in association with each other.

Hereinafter, various example embodiments of the present disclosure will be described in detail with reference to accompanying drawings.

Figure 2:
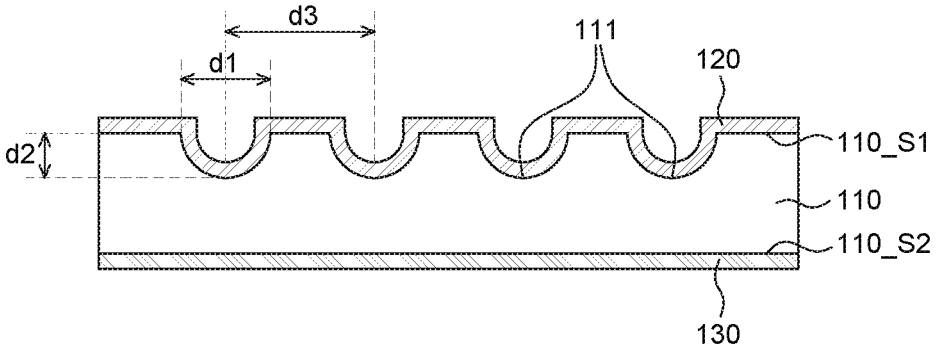
FIG. 2 is a cross-sectional view taken along the line II-II' of FIG. 1.

FIG. 1 is an exploded perspective view of a film speaker 100 according to an example embodiment of the present disclosure. FIG. 2 is a cross-sectional view taken along the line II-II' of FIG. 1.

Referring to FIGS. 1 and 2, the film speaker 100 includes an electroactive layer 110, a first electrode 120, and a second electrode 130.

The electroactive layer 110 is a plate type film formed of an electroactive polymer which is a polymer material which is deformed by electrical stimulation. The electroactive layer 110 is a base member of the film speaker 100. When an electric field is applied to the electroactive layer 110, an alignment direction of dipoles in the electroactive polymer which configures the electroactive layer 110 is changed. Therefore, the electroactive layer 110 is vibrated by the electrostatic attractive force or repulsive force.

The electroactive layer 110 may be formed of polyvinylidene difluoride (PVDF) based polymer. For example, the electroactive layer 110 may be formed of a PVDF homopolymer, a PVDF copolymer such as polyvinylidene-trifluoroethylene (PVDF-TrFE), polyvinylidene-tetrafluoroethylene (PVDF-TFE), polyvinylidene-co-chlorotrifluoroethylene (PVDF-CTFE), or polyvinylidene-chlorofluoroethylene (PVDF-CFE), or a PVDF terpolymer such as polyvinylidene-trifluoroethylene-chlorofluoroethylene (PVDF-TrFE-CFE) or polyvinylidene-trifluoroethylene-co-chlorotrifluoroethylene (PVDF-TrFE-CTFE).

The PVDF copolymer and the PVDF terpolymer are ferroelectric polymer or relaxed ferroelectric polymer so that the PVDF copolymer and the PVDF terpolymer may advantageously generate large vibration even at a low driving voltage. Further, in the PVDF copolymer and the PVDF terpolymer, trifluoroethylene (TrFE) is randomly coupled to PVDF to naturally form β phase by an electronegativity between the hydrogen (H) atom and the fluorine (F) atom. Therefore, when the electroactive layer 110 is formed of the PVDF copolymer and the PVDF terpolymer, a polling process for forming a β phase may be omitted. Therefore, there are advantages in that a manufacturing process of the film speaker 100 may be simplified and a manufacturing cost may be saved. Further, the film type electroactive layer 110 has an excellent transmittance so that the film speaker 100 is attached to the entire surface of the display panel to be easily applied to the display device.

Further, the electroactive layer 110 may be formed of cyanopolymer such as poly-vinylidene cyanide (PVDCN), cyano-copolymer such as PVDCN vinyl acetate or PVDCN vinyl propionate, or borane nitride (BN) polymer such as polyaminoborane or polyaminodifluoroborane.

Referring to FIGS. 1 and 2, the electroactive layer 110 includes a plurality of concave portions 111. That is, the electroactive layer 110 may include a plurality of concave portions 111 which is formed such that a surface of the electroactive layer 110 is inwardly recessed to the electroactive layer 110. Therefore, the electroactive layer 110 may have a plurality of concave and convex structures.

The plurality of concave portions 111 is disposed on a first surface 110_S1 of the electroactive layer 110. That is, the electroactive layer 110 may include a plurality of concave portions 111 such as a plurality of concave and convex structures, on one surface of a plurality of surfaces of the electroactive layer 110. Even though in FIGS. 1 and 2, it is illustrated that the plurality of concave portions 111 is disposed on the first surface 110_S1 which is an upper surface of the electroactive layer 110, it is not limited thereto. The plurality of concave portions 111 may be disposed on an opposite surface of the first surface 110_S1, that is, a lower surface of the electroactive layer 110. Further, the plurality of concave portions 111 may be formed on both the first surface 110_S1 and a second surface 110_S2 of the electroactive layer 110. Various arrangements and formation positions of the plurality of concave portions 111 will be described in detail with reference to FIGS. 3A to 3C.

Referring to FIG. 2, a shape of a cross-section of the plurality of concave portions 111 is a semicircle. Further, referring to FIG. 1, a shape of the plurality of concave portions 111 is a hemisphere. In order to form the plurality of concave portions 111 having the above-described shape, the electroactive layer 110 may be manufactured by molding the electroactive layer 110 which is formed to be flat. For example, the electroactive layer 110 may be formed by molding the plurality of concave portions 111 using a roller on which a plurality of bumps are formed after forming the electroactive layer 110 to be flat.

Specifically, the roller on which a plurality of bumps are formed may be applied to the first surface 110_S1 of the electroactive layer 110 and a flat roller on which a plurality of bumps are not formed may be applied to the second surface 110_S2 of the electroactive layer 110. The electroactive layer 110 may pass between two rollers while the rollers are in contact with the first surface 110_S1 and the second surface 110_S2. Through the process of causing the electroactive layer to pass between two rollers, the plurality of concave portions 111 may be formed on the first surface 110_S1 of the electroactive layer 110 and the plurality of concave portions may not be formed on the second surface 110_S2 of the electroactive layer 110. On the contrary, the plurality of concave portions 111 may be formed on the second surface 110_S2, rather than the first surface 110_S1. Specifically, the plurality of concave portions 111 is not formed on the first surface 110_S1 of the electroactive layer 110 but the plurality of concave portions 111 may be formed only on the second surface 110_S2. In this instance, the plurality of bumps are not formed on a roller which is in contact with the first surface 110_S1 of the electroactive layer 110, but may be formed only on a roller which is in contact with the second surface 110_S2 of the electroactive layer 110. During the process of causing a flat electroactive layer 110 on which the plurality of concave portions 111 is not formed to pass between two rollers, the plurality of concave portions 111 may be formed only on the second surface 110_S2 of the electroactive layer 110. However, the manufacturing process of the film speaker 100 is not limited thereto, and the film speaker may be formed through a printing process, a spray process, or a spin coating process.

The plurality of concave portions 111 may be formed on the surface of the first surface 110_S1 of the electroactive layer 110 on which the plurality of concave portions 111 is formed to have a circular shape. Specifically, a cross-section of the electroactive layer 110 including the plurality of concave portions 111 may be a semi-circle as illustrated in FIG. 2. A diameter d1 of the plurality of concave portions 111 may correspond to a diameter of a circle and a depth d2 of the plurality of concave portions 111 may correspond to a radius of the circle. Therefore, the depth d2 of the plurality of concave portions 111 may be half the diameter d1, but it is not limited thereto. The depth d2 may be longer or shorter than the diameter d1. Accordingly, a shape of the cross-section of the plurality of concave portions 111 may be an ellipse.

In FIGS. 1 and 2, the diameters d1 of the plurality of concave portions 111 are all the same, but are not limited thereto. A diameter of some of the plurality of concave portions 111 may be different from a diameter of the others. That is, a diameter of some of the plurality of concave portions 111 may be larger or smaller than the diameter of the others.

As compared with an instance that the diameter of some of the plurality of concave portions 111 is different from the diameter of the others, when the plurality of concave portions 111 has the same diameter, a sound pressure level of the film speaker 100 may be further improved. As the plurality of concave portions 111 is formed, resonance according to the vibration of an air layer which is in contact with a recessed part of the surface of the film speaker 100 may be significant. In this instance, when all the plurality of concave portions 111 has the same diameter, the vibration of the air layer which is in contact with the recessed part of the film speaker 100 may be more regular than the instance when the plurality of concave portions 111 has different diameters. Therefore, when all the plurality of concave portions 111 has the same diameter, the change in the sound pressure level of the film speaker 100 in accordance with the change of a frequency of a sound wave may be small. That is, when the diameters of the plurality of concave portions 111 are different from each other, the resonance level according to the frequency may vary. Therefore, the change in the sound pressure level of the film speaker 100 according to the change of a frequency may be large. On the contrary, when the diameters of the plurality of concave portions 111 are the same, the resonance level according to the frequency may be regular. Therefore, the change in the sound pressure level of the film speaker 100 according to the change of a frequency of a sound may be small. Therefore, the film speaker 100 according to the example embodiment of the present disclosure forms the plurality of concave portions 111 to have the same diameter so that the change of the sound pressure level of the film speaker 100 according to the frequency is reduced and thus the sound pressure level is effectively improved.

The diameters d1 of the plurality of concave portions 111 may be 1 cm or larger and 3 cm or smaller. When diameters d1 of the plurality of concave portions 111 are 1 cm or larger and 3 cm or smaller, the sound pressure level of the film speaker 100 may be significantly improved. The improvement of the sound pressure level when the diameters d1 of the plurality of concave portions 111 are 1 cm or larger and 3 cm or smaller will be described in detail with reference to FIG. 10. In other embodiments of the present disclosure, depths, size and/or area of the plurality of concave portions 111 may be different from one another, and such concave portions 111 having differences may be arranged regularly, randomly or by groupings or clusters.

A distance d3 between the plurality of concave portions 111 may be adjusted. For example, the distance d3 between the plurality of concave portions 111 is larger than the diameter d1 of the plurality of concave portions 111. The distance d3 between the plurality of concave portions 111 may be appropriately adjusted within a range larger than the diameter d1 of the plurality of concave portions 111. The distance d3 between the plurality of concave portions 111 may be adjusted in accordance with a characteristic of a sound generated by the film speaker 100. Specifically, as the distance d3 between the plurality of concave portions 111 is reduced, the sound pressure level of the film speaker 100 may be increased. As the distance d3 between the plurality of concave portions 111 is reduced, the number of the plurality of concave portions 111 provided on the electroactive layer 110 may be increased. That is, when the diameter d1 of the plurality of concave portions 111 is constant, as the distance d3 between the plurality of concave portions 111 is reduced, the plurality of concave portions 111 may be further closely formed.

Accordingly, the number of plurality of concave portions 111 which can be provided on the electroactive layer 110 having a predetermined size may be increased as the distance d3 between the plurality of concave portions 111 is reduced. Therefore, as the number of the plurality of concave portions 111 is increased, a surface area of the electroactive layer 110 may be further increased. As a result, the sound pressure level of the film speaker 100 may be increased.

The first electrode 120 and the second electrode 130 are electrodes for applying the voltage to the electroactive layer 110 and are formed of a conductive material. Further, in order to ensure the transmittance of the film speaker 100, the first electrode 120 and the second electrode 130 may be formed of a transparent conductive material such as indium tin oxide (ITO), aluminum doped zinc oxide (AZO), fluorine tin oxide (FTC)), PEDOT:PSS, or silver-nanowire (AgNW). Further, the first electrode 120 and the second electrode 130 may be configured by a metal mesh. That is, the first electrode 120 and the second electrode 130 are configured by a metal mesh in which a metal material is disposed in the form of a net so that the first electrode 120 and the second electrode 130 may substantially serve as transparent electrodes. However, constituent materials of the first electrode 120 and the second electrode 130 are not limited to the above-described example but various transparent conductive materials may be used as the constituent materials. The first electrode 120 and the second electrode 130 may be formed of the same material or different materials.

The first electrode 120 and the second electrode 130 are disposed on the first surface 110_S1 of the electroactive layer 110 and the second surface 110_S2 which is opposite to the first surface 110_S1. That is, as illustrated in FIGS. 1 and 2, the first electrode 120 is disposed on the first surface 110_S1 which is an upper surface of the electroactive layer 110 and the second electrode 130 is disposed on the second surface 110_S2 which is a lower surface of the electroactive layer 110.

The first electrode 120 and the second electrode 130 are conformally disposed along the first surface 110_S1 and the second surface 110_S2 of the electroactive layer 110. The first electrode 120 and the second electrode 130 may be conformally disposed while forming curves along surfaces of the plurality of concave portions 111 provided on the electroactive layer 110. Therefore, as illustrated in FIG. 2, the first electrode 120 is disposed along or in the plurality of concave portions 111 disposed on the first surface 110_S1 of the electroactive layer 110 and the second electrode 130 is disposed along the second surface 110_S2 of the electroactive layer 110 which is a flat surface.

Since in the film speaker 100 according to the example embodiment of the present disclosure, the electroactive layer 110 includes the plurality of concave portions 111, there may be a space where the sound resonates. In this instance, when a voltage is applied to the film speaker 100, the electroactive layer 110 vibrates and air in the concave space of the plurality of concave portions 111 of the electroactive layer 110 may vibrate by the vibration of the electroactive layer 110. In this instance, the vibration of the air may cause the resonance to be maximized and thus the sound pressure level may be improved.

Further, since the electroactive layer 110 includes the plurality of concave portions 111, the surface area of the electroactive layer 110 is increased and a blocking force of the film speaker 100 is increased. The blocking force means a maximum force generated when the film speaker 100 vibrates and satisfies the relationship represented by the following Equation 1.

$$F \propto N\left(\frac{S}{L}\right) Y d_{33} V \qquad \text{[Equation 1]}$$

Here, F denotes a magnitude of the blocking force, N denotes the number of laminated layers of the electroactive layer 110, S denotes a surface area of the electroactive layer 110, L denotes a thickness of the electroactive layer 110, $d_{33}$ denotes a piezoelectric coefficient of the electroactive layer 110, Y denotes a Young's modulus of the electroactive layer 110, and V denotes an intensity of a voltage applied to the electroactive layer 110.

As the blocking force of the film speaker 100 is increased, the film speaker 100 may generate a larger vibration and transmit a larger sound pressure to the outside.

As seen from Equation 1, the blocking force of the film speaker 100 is proportional to the surface area of the film speaker 100. Further, as described above, the electroactive layer 110 of the film speaker 100 according to the example embodiment of the present disclosure includes the plurality of concave portions 111 so that the electroactive layer 110 has a concave and convex structure. Therefore, as compared with a film speaker 100 which does not include a plurality of concave portions 111, the blocking force of the film speaker 100 according to the example embodiment of the present disclosure is improved. Therefore, a vibration intensity of the film speaker 100 is improved and an intensity of the sound pressure generated by the film speaker 100 according to the enhanced vibration intensity is increased so that the sound may be effectively reproduced. Further, an intensity of the voltage, that is, a driving voltage, which needs to be applied to the electroactive layer 110 to form the same sound pressure level may be reduced. Therefore, a required sound pressure level may be obtained even at a low driving voltage.

Figure 3A:
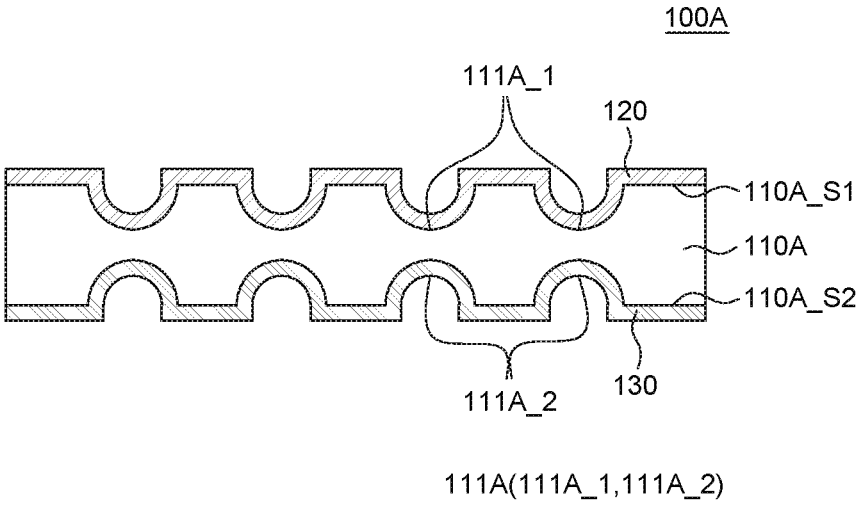
FIGS. 3A to 3C are cross-sectional views of a film speaker according to various example embodiments of the present disclosure.
Figure 3B:
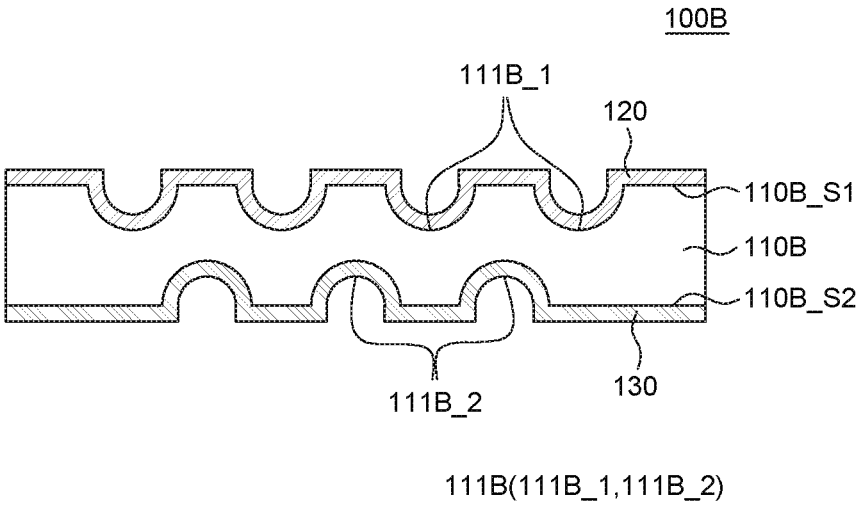
Figure 3C:
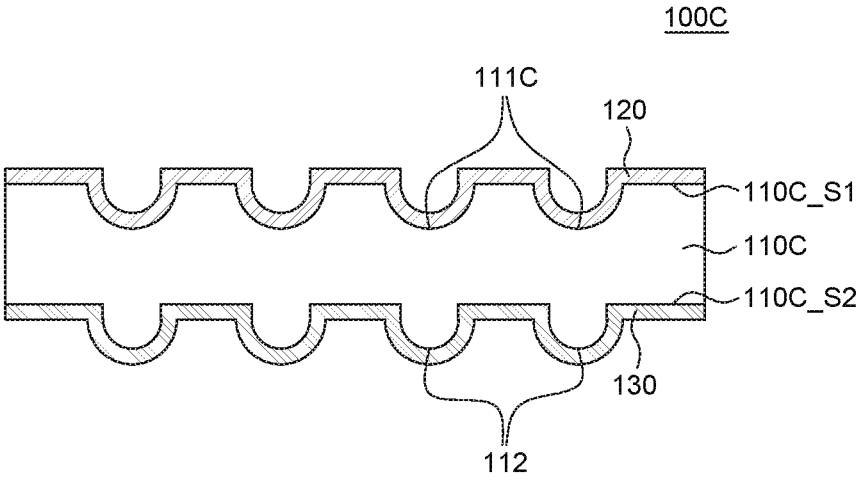

FIGS. 3A to 3C are cross-sectional views of a film speaker according to various example embodiments of the present disclosure. Referring to FIGS. 3A and 3B, electroactive layers 110A and 110B include a plurality of concave portions 111A and 111B disposed on all first surfaces 110A_S1 and 110B_S1 and second surfaces 110A S2 and 110B S2 which are opposites to the first surfaces 110A_S1 and 110B_S1. Further, referring to FIG. 3C, the electroactive layer 110C includes a plurality of concave portions 111C on the first surface 110C_S1 and a plurality of convex portions 112 on the second surface 110C_S2.

First, referring to FIG. 3A, both the first surface 110A_S1 and the second surface 110A S2 of the electroactive layer 110A include a plurality of concave portions 111A. Specifically, among the plurality of concave portions 111A, concave portions 111A 1 disposed on the first surface 110A_S1 of the electroactive layer 110A may be disposed to correspond to concave portions 111A 2 disposed on the second surface 110A S2 of the electroactive layer 110A. That is, the concave portions 111A 1 disposed on the first surface 110A_S1 of the electroactive layer 110A and the concave portions 111A 2 disposed on the second surface 110A S2 of the electroactive layer 110A may be disposed to face each other.

In the film speaker 100A according to another example embodiment of the present disclosure, the plurality of concave portions 111A is provided on both the first surface 110A_S1 and the second surface 110A S2 of the electroactive layer 110A. Therefore, the surface area of the electroactive layer 110A is increased so that the sound pressure level of the film speaker 100A may be improved. Specifically, the first surface 110A_S1 of the electroactive layer 110A includes the plurality of concave portions 111A 1 and the second surface 110A S2 includes the plurality of concave portions 111A 2. In this instance, a space where the sound resonates by the concave and convex structure of the plurality of concave portions 111A may be generated, and the sound pressure level of the film speaker 100A may be improved by the resonance. Further, the cross-sectional area of the electroactive layer 110A may be further increased by the concave and convex structure of the plurality of concave portions 111A and the blocking force of the electroactive layer 110A may be increased. Therefore, the vibration intensity of the electroactive layer 110A may be improved and the sound pressure level of the film speaker 100A may be increased.

When the plurality of concave portions 111A is formed on both the first surface 110A_S1 and the second surface 110A S2 of the electroactive layer 110A, as compared with the instance when the plurality of concave portions are formed on only one surface, more spaces where the sound resonates may be ensured and the surface area of the electroactive layer 110A is further increased. Therefore, the sound pressure level of the film speaker 100A may be further increased.

Referring to FIG. 3B, both the first surface 110B_S1 and the second surface 110B S2 of the electroactive layer 110B include a plurality of concave portions 111B. Specifically, among the plurality of concave portions 111B, concave portions 111B 1 disposed on the first surface 110B_S1 of the electroactive layer 110B and concave portions 111B 2 disposed on the second surface 110B S2 of the electroactive layer 110B are alternately disposed. That is, the concave portions 111B 1 of the first surface 110B_S1 of the electroactive layer 110B and the concave portions 111B 2 of the second surface 110B S2 of the electroactive layer 110B may be alternately disposed without facing each other.

In the film speaker 100B according to another example embodiment of the present disclosure, the concave portions 111B 1 disposed on the first surface 110B_S1 of the electroactive layer 110B and the concave portions 111B 2 disposed on the second surface 110B S2 of the electroactive layer 110B are alternately disposed. Therefore, the plurality of concave portions 111B is disposed on both surfaces of the electroactive layer 110B. Accordingly, the sound pressure level of the film speaker 100B may be increased for the same reason as described above with reference to FIG. 3A.

Further, in the film speaker 100B according to another example embodiment of the present disclosure, not only the sound pressure level is improved, but also the thickness of the film speaker 100B is further reduced. Specifically, the thickness of the electroactive layer 110B needs to be larger than the thickness of the plurality of concave portions 111 provided on the electroactive layer 110B. For example, when the plurality of concave portions are disposed to overlap each other on both surfaces of the electroactive layer, the thickness of the electroactive layer needs to be larger than two times the depth of the plurality of concave portions. However, as illustrated in FIG. 3B, when the plurality of concave portions 111B of the first surface 110B_S1 and the second surface 110B S2 of the electroactive layer 110B is alternately disposed, the thickness of the electroactive layer 110B may be smaller than two times the depth d2 of the plurality of concave portions 111B. Therefore, as the plurality of concave portions 111B of the first surface 110B_S1 and the second surface 110B S2 of the electroactive layer 110B is alternately disposed, the thickness of the electroactive layer 110B may be reduced so that the film speaker 100B may be formed to be thinner. Further, when the film speaker 100B is formed to be thin, the transmittance of the film speaker 100B is improved and the driving voltage of the film speaker 100B is also reduced.

In order to form the plurality of concave portions 111A and 111B as illustrated in FIGS. 3A and 3B, the electroactive layer 110A and 110B may be manufactured by molding the electroactive layers 110A and 110B which are formed to be flat. For example, the electroactive layers 110A and 110B may be formed by molding the plurality of concave portions 111A and 111B using a roller on which a plurality of bumps are formed after forming the electroactive layers 110A and 110B to be flat. For example, a roller on which a plurality of bumps are formed may be applied to the first surfaces 110A_S1 and 110B_S1 and the second surfaces 110A S2 and 110B S2 of the electroactive layers 110A and 110B. The electroactive layers 110A and 110B may pass between two rollers while the rollers are in contact with the first surfaces 110A_S1 and 110B_S1 and the second surfaces 110A S2 and 110B S2. The plurality of concave portions 111A and 111B may be formed on the first surfaces 110A_S1 and 110B_S1 and the second surfaces 110A S2 and 110B S2 of the electroactive layers 110A and 110B through the process of causing the electroactive layers to pass between two rollers.

In FIG. 3A, when the bump structures formed on two rollers are in contact with the electroactive layer 110A, the bump structures formed on the rollers may be disposed in corresponding positions. Therefore, the plurality of concave portions 111A formed on the first surface 110A_S1 and the second surface 110A S2 of the electroactive layer 110A may be formed to correspond to each other.

In FIG. 3B, when the bump structures formed on two rollers are in contact with the electroactive layer 110B, the bump structures formed on two rollers may be disposed in alternate positions. Therefore, the plurality of concave portions 111B formed on the first surface 110B_S1 and the second surface 110B S2 of the electroactive layer 110B may be formed to be alternately disposed.

Referring to FIG. 3C, a plurality of concave portions 111C is disposed on a first surface 110C_S1 of an electroactive layer 110C and a plurality of convex portions 112 may be disposed on a second surface 110C_S2 of the electroactive layer 110C on which the plurality of concave portions 111C is not disposed. Differently from the plurality of concave portions 111C, the plurality of convex portions 112 refers to a convex structure which outwardly protrudes from the electroactive layer 110C with respect to the surface of the electroactive layer 110C. The plurality of concave portions 111C may be disposed on the first surface 110C_S1 of the electroactive layer 110C and the plurality of convex portions 112 may be disposed on the second surface 110C_S2 of the electroactive layer 110C, but is not limited thereto. The plurality of convex portions 112 may be disposed on the first surface 110C_S1 of the electroactive layer 110C and the plurality of concave portions 111C may be disposed on the second surface 110C_S2 of the electroactive layer 110C.

In the film speaker 100C according to another example embodiment of the present disclosure, the plurality of concave portions 111C is disposed on one of the first surface 110C_S1 and the second surface 110C_S2 of the electroactive layer 110C and the plurality of convex portions 112 is disposed on the other surface of the electroactive layer 110C on which the plurality of concave portions 111C is not formed. Therefore, the sound pressure level may be efficiently increased and the thickness of the film speaker 100C may be reduced. That is, a space where the sound resonates may be generated by the plurality of concave portions 111C and the sound pressure level may be improved by the resonance. Further, when the plurality of convex portions 112 is formed on the electroactive layer 110C, the surface area of the electroactive layer 110C may be increased due to the concave and convex structure as in the instance where the surface area of the electroactive layer 110C is increased. As described above, when the surface area of the electroactive layer 110C is increased, the blocking force of the electroactive layer 110C is increased so that the sound pressure level of the film speaker 100C is increased.

The plurality of concave portions 111C and the plurality of convex portions 112 illustrated in FIG. 3C may be formed by molding the electroactive layer 110C which is formed to be flat. For example, the plurality of concave portions 111C and the plurality of convex portions 112 may be formed by pressurizing the flat electroactive layer 110C using a roller having a plurality of concave and convex structures. Specifically, a roller which will form a plurality of bumps having a convex shape may be applied to the first surface 110C_S1 of the electroactive layer 110C. Specifically, a roller which will form a plurality of bumps having a concave shape may be applied to the second surface 110C_S2 of the electroactive layer 110C. Two rollers on which a plurality of bumps are formed may be applied to the first surface 110C_S1 and the second surface 110C_S2 of the electroactive layer 110C. The electroactive layer 110C may pass between two rollers. Therefore, the plurality of concave portions 111C may be formed on the first surface 110C_S1 of the electroactive layer 110C and the plurality of convex portions 112 may be formed on the second surface 110C_S2 of the electroactive layer 110C.

Figure 4A:
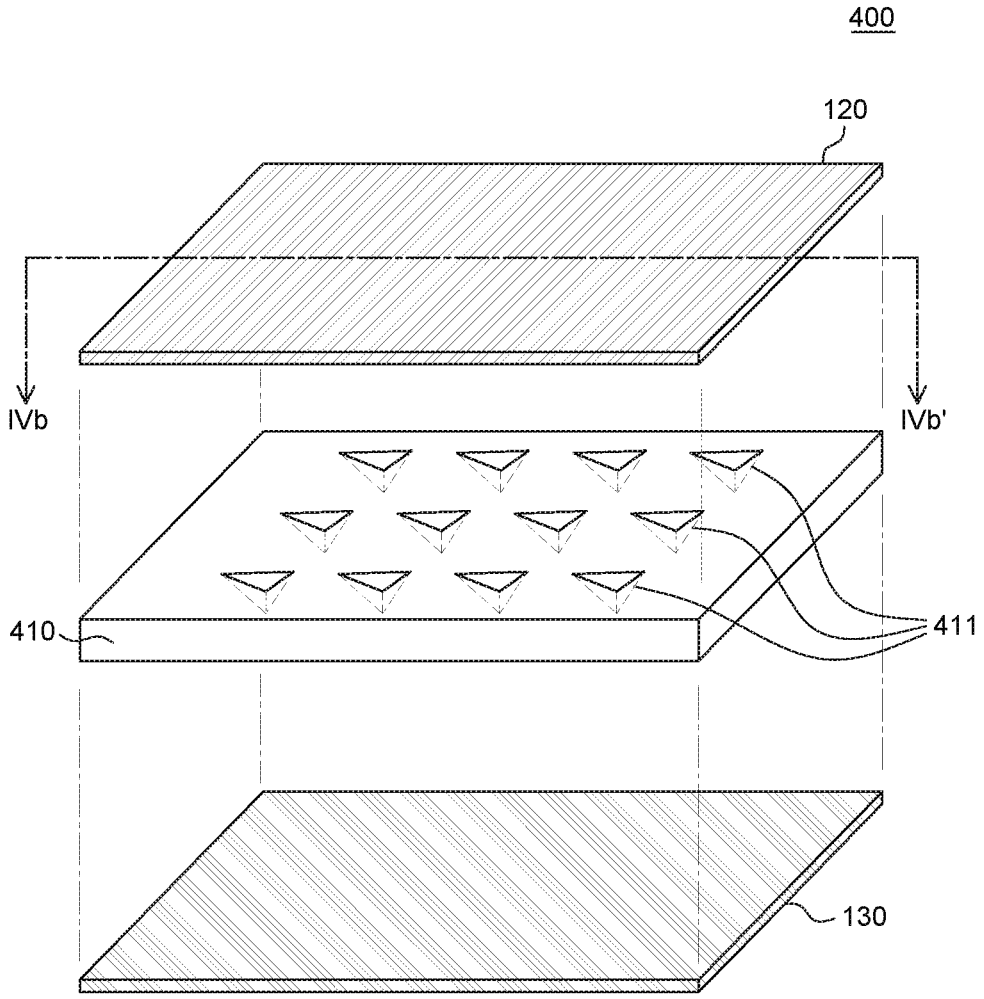
FIG. 4A is an exploded perspective view of a film speaker according to another example embodiment of the present disclosure.
Figure 4B:
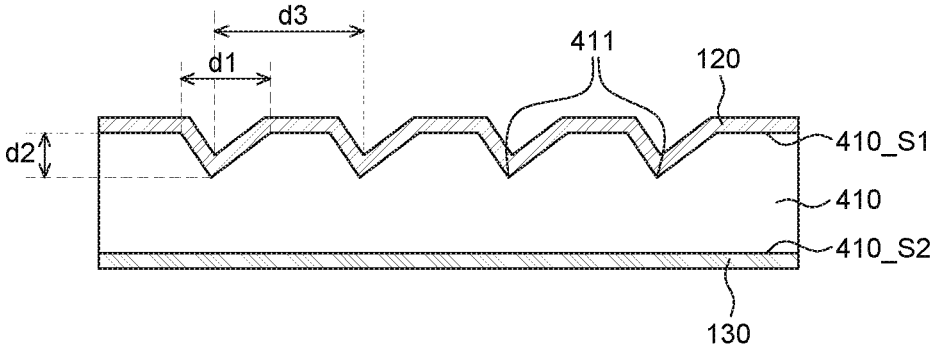
FIG. 4B is a cross-sectional view taken along the line IVb-IVb' of FIG. 4A.
Figure 5A:
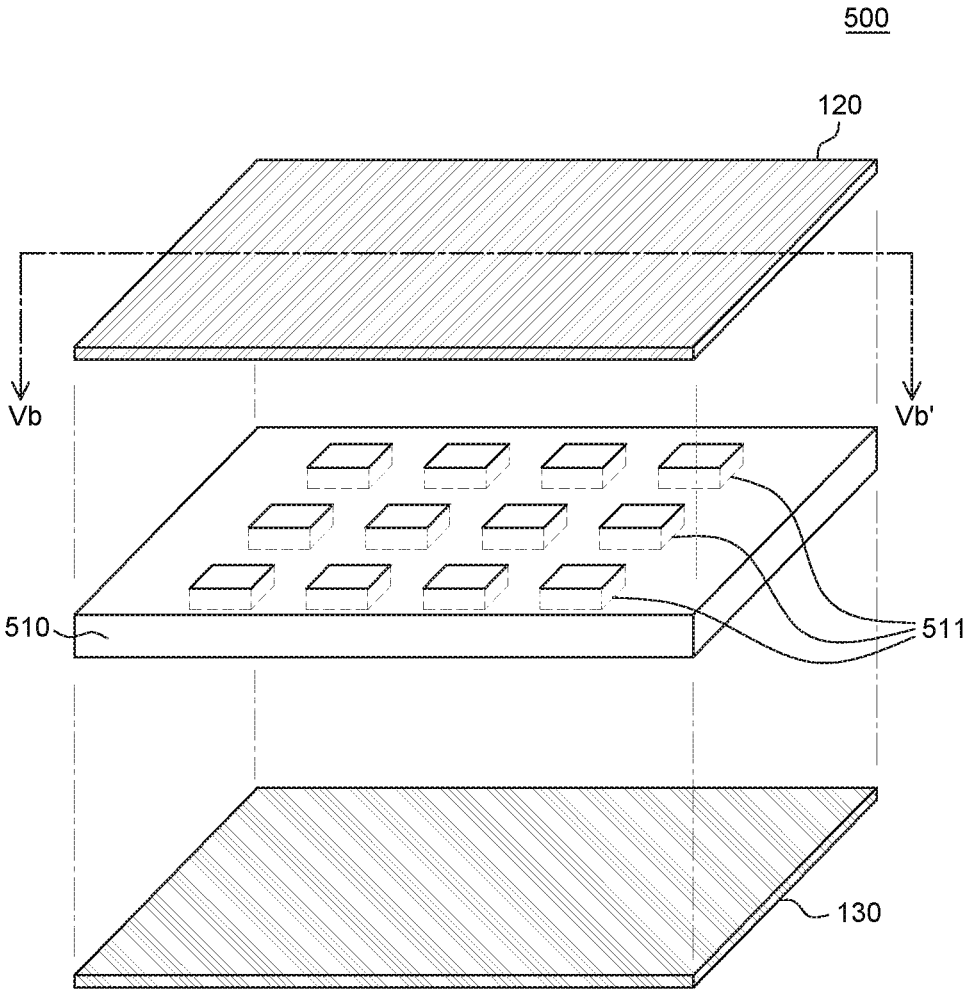
FIG. 5A is an exploded perspective view of a film speaker according to an example embodiment of the present disclosure.
Figure 5B:
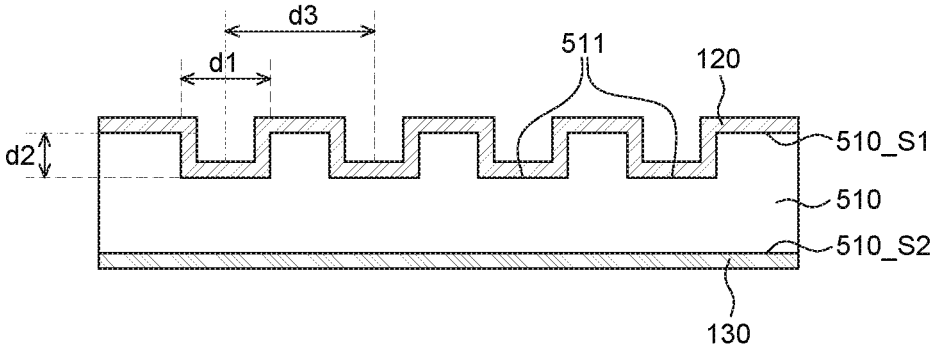
FIG. 5B is a cross-sectional view taken along the line Vb-Vb' of FIG. 5A.

FIG. 4A is an exploded perspective view of a film speaker according to another example embodiment of the present disclosure. FIG. 4B is a cross-sectional view taken along the line IVb-IVb' of FIG. 4A. FIG. 5A is an exploded perspective view of a film speaker according to another example embodiment of the present disclosure. FIG. 5B is a cross-sectional view taken along the line Vb-Vb' of FIG. 5A. Film speakers 400 and 500 illustrated in FIGS. 4A to 5B are substantially the same as the film speaker 100 illustrated in FIGS. 1 and 2 except for the shapes of the plurality of concave portions 411 and 511 of the electroactive layers 410 and 510. Therefore, a redundant description will be omitted.

First, referring to FIGS. 4A and 4B, an electroactive layer 410 includes a plurality of concave portions 411 having a triangular cross-section. The first surface 410 S1 of the electroactive layer 410 may include a plurality of concave portions 411 having a triangular cross-section and the second surface 410 S2 of the electroactive layer 410 which is opposite to the first surface 410 S1 may not include the plurality of concave portions 411. Specifically, the plurality of concave portions 411 may be a tetrahedron. Therefore, the plurality of concave portions 411 may have a triangular shape on the surface of the electroactive layer 410 and the cross-section of the electroactive layer 410. In FIGS. 4A and 4B, it is assumed that the plurality of concave portions 411 is a regular tetrahedron. Therefore, the plurality of concave portions 411 may have a regular triangular shape on the surface of the electroactive layer 410 and as illustrated in FIG. 4B, the plurality of concave portions 411 may have a triangular shape on the cross-section of the electroactive layer 410, rather than the regular triangular shape. The diameter d1 of the plurality of concave portions 411 may be a length corresponding to a height of the regular triangle corresponding to one surface of the regular tetrahedron, which is the shape of the plurality of concave portions 411. Further, the depth d2 of the plurality of concave portions 411 may correspond to a distance from one vertex of the tetrahedron to one surface facing the vertex. However, the plurality of concave portions 411 having a triangular cross-section is not limited thereto. The plurality of concave portions 411 is not the regular tetrahedron, but may be a tetrahedron in which sides are not the same, under the condition that the shape of the cross-section is a triangle.

Further, a plurality of concave portions or a plurality of convex portions may be formed on the second surface 410 S2 of the electroactive layer 410 which is opposite to the first surface 410 S1. That is, in the film speakers 100A, 100B, and 100C as illustrated in FIGS. 3A to 3C, only the shapes of the plurality of concave portions and the plurality of convex portions may be replaced with the shape of the plurality of concave portions 411 illustrated in FIGS. 4A and 4B.

Next, referring to FIGS. 5A and 5B, an electroactive layer 510 includes a plurality of concave portions 511 having a quadrangular cross-section. The first surface 510_S1 of the electroactive layer 510 may include a plurality of concave portions 511 having a quadrangular cross-section and the second surface 510_S2 of the electroactive layer 510 which is opposite to the first surface 510_S1 may not include the plurality of concave portions 511. Specifically, the plurality of concave portions 511 may be a regular hexahedron. Therefore, the plurality of concave portions 511 may have a quadrangular shape on the surface of the electroactive layer 510 and the cross-section of the electroactive layer 510. In FIGS. 5A and 5B, it is assumed that the plurality of concave portions 511 is a regular hexahedron. Therefore, the plurality of concave portions 511 may have a regular quadrangular shape on the surface and the cross-section of the electroactive layer 510. A diameter d1 and a depth d2 of the plurality of concave portions 511 may be a length of one surface of the regular hexahedron which is a shape of the plurality of concave portions 511. However, the plurality of concave portions 511 having a quadrangular cross-section is not limited thereto.

The plurality of concave portions 511 is not a regular hexahedron and may be a hexahedron in which some surfaces are rectangles under the condition that the cross-sectional shape is a quadrangle.

Further, a plurality of concave portions or a plurality of convex portions may be formed on the second surface 510_S2 of the electroactive layer 510 which is opposite to the first surface 510_S1. That is, in the film speakers 100A, 100B, and 100C as illustrated in FIGS. 3A to 3C, only the shapes of the plurality of concave portions and the plurality of convex portions may be replaced with the shape of the plurality of concave portions 511 illustrated in FIGS. 5A and 5B.

Further, the shape of the cross-section of the plurality of concave portions 411 and 511 is not limited to the triangle and the quadrangle, but may be various polygons. For example, the shape of the cross-section of the plurality of concave portions 411 and 511 may be a pentagon or a hexagon. Further, the shape of the cross-section of the plurality of concave portions 411 and 511 is a polygon but the shape of the plurality of concave portions 411 and 511 viewed from the surface of the electroactive layers 410 and 510 on which the plurality of concave portions are formed may not be a polygon. For example, the shape of the plurality of concave portions 411 and 511 may be a conical shape. Specifically, when the shape of the plurality of concave portions 411 and 511 is a conical shape, the shape of the cross-section of the plurality of concave portions 411 and 511 is a triangle and the plurality of concave portions 411 and 511 viewed from the surface of the electroactive layers 410 and 510 may have a circular shape.

In the film speakers 400 and 500 according to another example embodiment of the present disclosure, the electroactive layers 410 and 510 include a plurality of concave portions 411 and 511 having a polygonal cross-section to effectively improve the sound pressure level. Specifically, the electroactive layers 410 and 510 include a plurality of concave portions 411 and 511 having a polygonal cross-section so that an area where the electroactive layers 410 and 510 are in contact with air may be increased. Therefore, as described above, air which is in contact with the electroactive layers 410 and 510 in accordance with the vibration of the electroactive layers 410 and 510 may further efficiently vibrate. Therefore, the sound pressure level of the film speakers 400 and 500 may be improved. Further, referring to Equation 1, the blocking force of the film speakers 400 and 500 may be increased as the cross-sectional area of the film speakers 400 and 500 is increased. As compared with the instance that the electroactive layers 410 and 510 do not include the plurality of concave portions 411 and 511, when the plurality of concave portions 411 and 511 having a polygonal cross-section is included, the surface area of the electroactive layers 410 and 510 is increased. Accordingly, the blocking force may be increased and the sound pressure level of the film speakers 400 and 500 may be increased.

In some example embodiments, a shape of a cross-section of some of the plurality of concave portions 411 and 511 included in the electroactive layers 410 and 510 may be different from a shape of a cross-section of the others. That is, the plurality of concave portions 411 and 511 of the electroactive layers 410 and 510 may be configured by concave portions having different polygonal shapes. For example, the electroactive layers 410 and 510 may include both a plurality of concave portions 411 having a triangular cross-section and a plurality of concave portions 511 having a quadrangular cross-section. For example, the plurality of concave portions 411 having a triangular cross-section and the plurality of concave portions 511 having a quadrangular cross-section may be separately disposed on the first surfaces 410 S1 and 510_S1 and the second surfaces 410 S2 and 510_S2 of the electroactive layers 410 and 510, respectively. Further, both the plurality of concave portions 411 having a triangular cross-section and the plurality of concave portions 511 having a quadrangular cross-section may be disposed on the same surface of the electroactive layers 410 and 510.

In some example embodiments, a shape of the cross-section of some of the plurality of concave portions may be a polygon and a shape of the cross-section of the others may be a semicircle. Specifically, the plurality of concave portions 411 and 511 included in the electroactive layers 410 and 510 may have different shapes and the shape of the cross-section of some of the plurality of concave portions is a semicircle and a shape of the cross-section of the others is a polygon. For example, a plurality of concave portions 411 and 511 having a semicircular cross-section may be formed on the first surfaces 410 S1 and 510_S1 of the electroactive layers 410 and 510 and a plurality of concave portions 411 and 511 having a triangular cross-section may be formed on the second surfaces 410 S2 and 510_S2 of the electroactive layers 410 and 510. However, the shape of the cross-section of a plurality of concave portions included in the electroactive layer is not limited thereto and there may be various examples under the condition that the shape of the cross-section of some of the plurality of concave portions is a semicircle and the shape of the cross-section of the others is a polygon. Also, the plurality of concave portions may be arranged at different intervals from each other, and/or the plurality of concave portions having different cross-sections may be arranged differently. For example, some of the plurality of concave portions having one shape may be arranged at the periphery of the first or second surface, and other of the plurality of concave portions having another shape maybe arranged at the middle of the first or second surface, or the plurality of concave portions having different shapes maybe arranged randomly on the first or second surfaces, or may be clustered together by shape over the first or second surfaces.

Figure 6:
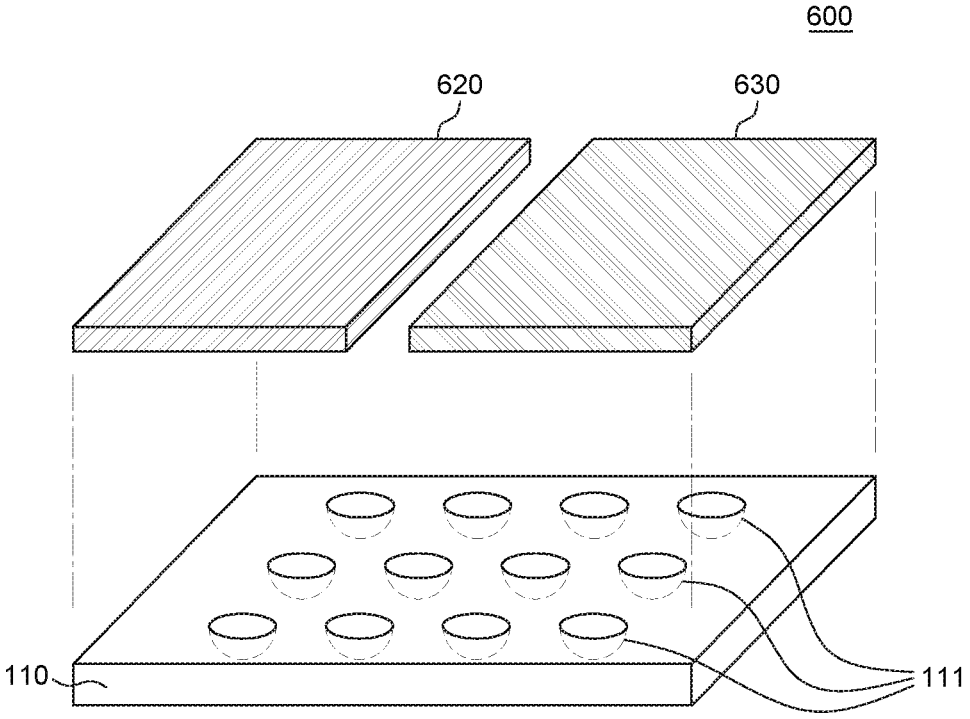
FIG. 6 is an exploded perspective view of a film speaker according to another example embodiment of the present disclosure.

FIG. 6 is an exploded perspective view of a film speaker according to another example embodiment of the present disclosure. The film speaker 600 illustrated in FIG. 6 is substantially the same as the film speaker 100 illustrated in FIGS. 1 and 2 except that a first electrode 620 and a second electrode 630 are formed on the same surface of the electroactive layer 110, so that a redundant description will be omitted.

Referring to FIG. 6, the first electrode 620 and the second electrode 630 are disposed on the same surface of the electroactive layer 110. In this instance, when a voltage is applied to the first electrode 620 and the second electrode 630, a horizontal electric field is generated between the first electrode 620 and the second electrode 630 based on a potential difference between the first electrode 620 and the second electrode 630. Therefore, the electroactive layer 110 may vibrate based on the horizontal electric field between the first electrode 620 and the second electrode 630.

The film speaker 600 according to another example embodiment of the present disclosure includes the first electrode 620 and the second electrode 630 formed on the same surface of the electroactive layer 110. Therefore, the film speaker 600 may provide excellent visibility. If the film speaker 600 is disposed above a display panel which displays images, the visibility of the display panel may be deteriorated due to the film speaker 600. Specifically, the first electrode 620 and the second electrode 630 may be formed of a transparent conductive material. Even though the first electrode 620 and the second electrode 630 are formed of a transparent conductive material, some of light which is incident onto the first electrode 620 and the second electrode 630 may be reflected or absorbed by the first electrode 620 and the second electrode 630. Therefore, since there may be light which does not pass through the first electrode 620 and the second electrode 630 among light which is incident onto the first electrode 620 and the second electrode 630, the transmittance of the film speaker 600 may be deteriorated due to the first electrode 620 and the second electrode 630. Specifically, when the first electrode 620 and the second electrode 630 are disposed on both surfaces of the electroactive layer 110, the transmittance may be further deteriorated due to the first electrode 620 and the second electrode 630. However, in the film speaker 600 according to another example embodiment of the present disclosure, the first electrode 620 and the second electrode 630 which are formed of the transparent conductive material are disposed on one surface of the electroactive layer 110. Therefore, since the number of electrodes through which the light incident onto the film speaker 600 passes is reduced from two to one, the transmittance of the film speaker 600 may be improved as compared with the instance when the first electrode 620 and the second electrode 630 are disposed on different surfaces of the electroactive layer 110.

Figure 7:
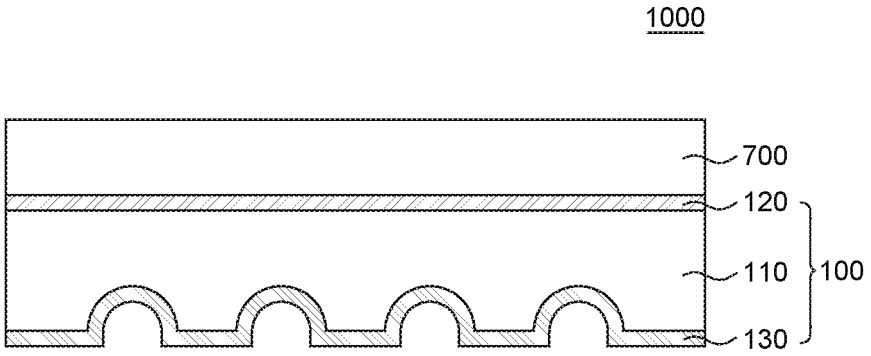
FIG. 7 is a cross-sectional view of a display device according to an example embodiment of the present disclosure.

FIG. 7 is a cross-sectional view of a display device according to an example embodiment of the present disclosure.

Referring to FIG. 7, a display device 1000 includes an organic light emitting display panel 700 and a film speaker 100. In FIG. 7, specific illustration of components of the organic light emitting display panel 700 is omitted. For the convenience of description, in FIG. 7, it is illustrated that the film speaker 100 illustrated in FIGS. 1 and 2 is applied to the display device 1000, but it is not limited thereto. Various film speakers 100A, 100B, 100C, 400, 500, and 600 illustrated in FIGS. 3A to 6 may be applied to the display device 1000.

The organic light emitting display panel 700 refers to a panel on which a display element for displaying images is disposed in the display device 1000. The organic light emitting display panel 700 may be disposed on a first surface which is an upper surface of the film speaker 100. That is, the film speaker 100 may be disposed below the organic light emitting display panel 700. Therefore, the image displayed by the organic light emitting display panel 700 may be viewed without passing through the film speaker 100. When a voltage is applied to the electroactive layer 110 of the film speaker 100, the electroactive layer 110 vibrates and the generated sound wave may be transmitted to the outside through the organic light emitting display panel 700. The vibration of the sound wave may be enhanced by the plurality of concave and convex structures provided on the second surface 110_S2 of the electroactive layer 110 and the sound pressure level of the film speaker 100 may be increased.

In the meantime, the display device 1000 may further include an adhesive member between the organic light emitting display panel 700 and the film speaker 100. The adhesive member is a member serving to combine the organic light emitting display panel 700 and the film speaker 100. Further, as illustrated in FIG. 7, the film speaker 100 may have a plurality of concave and convex structures only on a surface between the first surface and the second surface of the electroactive layer 110 which is farther from the first surface of the film speaker 100. That is, the plurality of concave and convex structures may be provided only on the second surface of the electroactive layer 110.

On the contrary, the electroactive layer 110 may also include the plurality of concave and convex structures on the first surface. Specifically, the electroactive layer 110 may include the plurality of concave and convex structures on both the first surface and the second surface. Further, the electroactive layer 110 may include the plurality of concave and convex structures on the first surface, but may not include the plurality of concave and convex structures on the second surface.

When the electroactive layer 110 includes the plurality of concave and convex structures on the first surface, the adhesive member between the first surface of the film speaker 100 and the organic light emitting display panel 700 may be formed only on an edge of the first surface of the film speaker 100. That is, the adhesive member is not formed in the plurality of concave and convex structures formed on the first surface of the film speaker 100 but the adhesive member may be formed only on the edge of the first surface of the film speaker 100 on which the plurality of concave and convex structures is not provided. The adhesive member may be a ring tape. The display device 1000 according to the example embodiment of the present disclosure may effectively improve the sound pressure level of the film speaker 100. If the plurality of concave and convex structures formed on the first surface of the film speaker 100 is filled with the adhesive member, the space for resonance of the sound is filled with the adhesive member so that the improvement of the sound pressure level by the resonance may not be provided. However, when the adhesive member is configured by a ring tape type, the space for resonance is formed in the concave portions of the film speaker 100 and the sound pressure level may be improved by the resonance. Therefore, the display device 1000 may effectively improve the sound pressure level of the film speaker 100.

In the display device 1000 according to the example embodiment of the present disclosure, the organic light emitting display panel 700 may be disposed above the film speaker 100. Therefore, the image displayed by the organic light emitting display panel 700 may be viewed without passing through the film speaker 100 so that the visibility of the display panel may not be deteriorated. When the film speaker 100 is disposed on the organic light emitting display panel 700, even though the film speaker 100 is transparent, light of the image displayed by the organic light emitting display panel 700 may be refracted or reflected by the film speaker 100 or absorbed by the film speaker 100. Therefore, the visibility of the organic light emitting display panel 700 may be deteriorated. Therefore, in the display device 1000 according to the example embodiment of the present disclosure, the organic light emitting display panel 700 is disposed on the film speaker 100 to maintain the visibility of the image displayed by the organic light emitting display panel 700. Further, in the display device 1000 according to the example embodiment of the present disclosure, the film speaker 100 is disposed below the organic light emitting display panel 700, so that distortion of the image displayed by the organic light emitting display panel 700 may be reduced.

Figure 8:
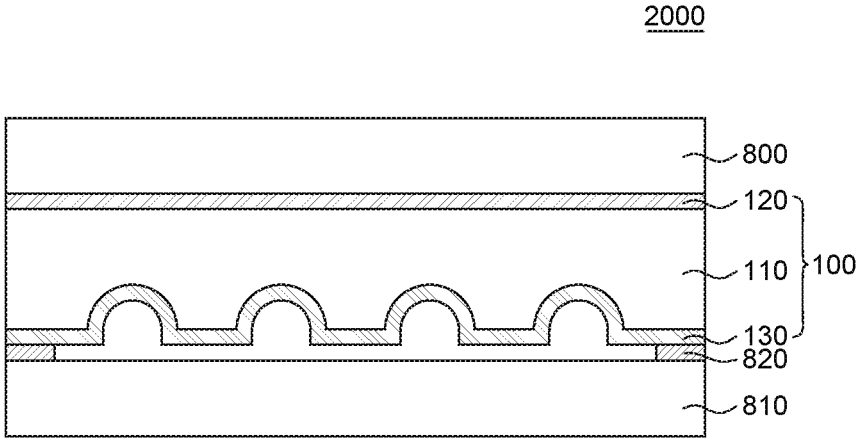
FIG. 8 is a cross-sectional view of a display device according to another example embodiment of the present disclosure.

FIG. 8 is a cross-sectional view of a display device according to another example embodiment of the present disclosure. Referring to FIG. 8, a display device 2000 includes a liquid crystal display panel 800, a film speaker 100, and a backlight unit 810. In FIG. 8, specific illustration of components of the liquid crystal display panel 800 is omitted. For the convenience of description, in FIG. 8, it is illustrated that the film speaker 100 illustrated in FIGS. 1 and 2 is applied to the display device 2000, but it is not limited thereto and various film speakers 100A, 100B, 100C, 400, 500, and 600 illustrated in FIGS. 3A to 6 may be applied to the display device 2000.

The liquid crystal display panel 800 refers to a panel on which a display element for displaying images is disposed in the display device 2000. The liquid crystal display panel 800 may be disposed on a first surface which is an upper surface of the film speaker 100. That is, the film speaker 100 may be disposed below the liquid crystal display panel 800. Therefore, the image displayed by the liquid crystal display panel 800 may be viewed without passing through the film speaker 100.

In the meantime, the display device 2000 may further include an adhesive member between the liquid crystal display panel 800 and the film speaker 100. The adhesive member is a member serving to combine the liquid crystal display panel 800 and the film speaker 100. When a plurality of concave and convex structures is not formed on the first surface of the film speaker 100 which is in contact with the liquid crystal display panel 800, the adhesive member may be formed on the entire first surface of the film speaker 100.

On the contrary, when the plurality of concave and convex structures is formed on the first surface of the film speaker 100, the adhesive member between the first surface of the film speaker 100 and the liquid crystal display panel 800 may be formed only on the edge of the first surface of the film speaker 100. That is, the adhesive member is not formed in the plurality of concave and convex structures formed on the first surface of the film speaker 100 but the adhesive member may be formed only on the edge of the first surface of the film speaker 100 on which the plurality of concave and convex structures is not provided. The adhesive member may be a ring tape, but other types of adhesive members or adhesives providing bonding or binding may be used.

The backlight unit 810 may be disposed to be adjacent to the second surface of the film speaker 100.

When the plurality of concave and convex structures is provided on the second surface of the film speaker 100 which is in contact with the backlight unit 810, the adhesive member 820 may be disposed only at an outer edge of the second surface of the film speaker 100. The adhesive member 820 may be a ring tape. When the backlight unit 810 and the film speaker 100 are connected using the adhesive member which covers the entire surface of the film speaker 100, the adhesive member may fill the plurality of concave and convex structures formed on the second surface of the film speaker 100. If the plurality of concave and convex structures is filled with the adhesive member, the space for resonating the sound is reduced and the function of the plurality of concave and convex structures which amplifies the vibration of the film speaker 100 may not be exhibited. Therefore, the backlight unit 810 and the film speaker 100 may be adhered to each other using an adhesive member 820, such as a ring tape, which may adhere an outer edge of the backlight unit 810 to an outer edge of the film speaker 100. Therefore, a space for resonating the sound may be formed between the backlight unit 810 and the second electrode 130 of the film speaker 100 and the sound pressure level of the film speaker 100 may be improved.

In the meantime, even though the backlight unit 810 is disposed below the film speaker 100 and some of light outgoing from the backlight unit 810 may be refracted and reflected by the film speaker 100, light incident onto the film speaker 100 is light before passing through a lower polarizer of the liquid crystal display panel 800. Therefore, the image quality of the liquid crystal display panel 800 may not be deteriorated by the film speaker 100.

In the display device 2000 according to another example embodiment of the present disclosure, the film speaker 100 is disposed below the liquid crystal display panel 800 to provide a sound wave having a high sound pressure level while implementing a display device 2000 having a thin thickness. Specifically, when a voltage is applied to the electroactive layer 110 of the film speaker 100, the electroactive layer 110 vibrates and the generated sound wave may be transmitted to the outside through the liquid crystal display panel 800. The vibration of the sound wave may be enhanced by the plurality of concave and convex structures provided on the second surface of the electroactive layer 110 and the sound pressure level of the film speaker 100 may be increased.

Further, in the display device 2000 according to another example embodiment of the present disclosure, the liquid crystal display panel 800 may be disposed above the film speaker 100. Therefore, the image displayed by the liquid crystal display panel 800 may be viewed without passing through the film speaker 100 so that the visibility of the display panel may not be deteriorated.

Figure 9:
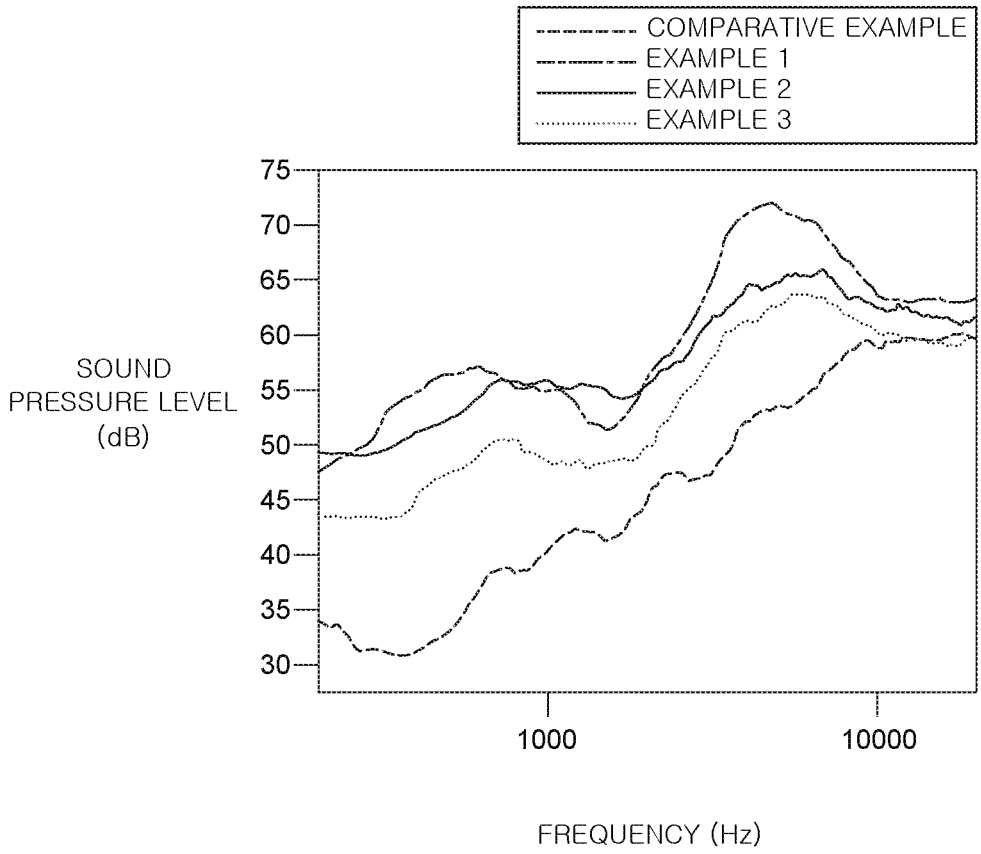
FIG. 9 is a graph for explaining a sound pressure level according to shapes of a cross-section of a plurality of concave portions of a film speaker which is included in a display device according to various examples of the present disclosure.

FIG. 9 is a graph for explaining a sound pressure level according to shapes of a cross-section of a plurality of concave portions of a film speaker which is included in a display device according to various examples of the present disclosure.

FIG. 9 illustrates sound pressure levels of a display device including a film speaker which does not include a plurality of concave portions according to a comparative example and a display device including a film speaker which includes a plurality of concave portions according to various examples. The display device according to the comparative example and the display device according to the examples have the same configuration except for whether the electroactive layer includes the plurality of concave portions. Specifically, both the display device according to the comparative example and the display device according to the examples include an organic light emitting display panel, an electroactive layer, a first electrode, and a second electrode. A weight of the organic light emitting display panel is 80 g. The electroactive layer is formed using PVDF and a thickness thereof is 100 μm. The first electrode and the second electrode are formed using ITO, have a thickness of 300 nm and a resistance of 100 Ω/square. All the electroactive layer, the first electrode, and the second electrode are formed to be a rectangle having a size of 21 cm×29.7 cm. A diameter d1 of all the plurality of concave portions of the display device according to the examples is 3 cm and a distance d3 between the plurality of concave portions is 3.5 cm.

In Example 1, the film type speaker includes a plurality of concave portions having a circular cross-section and the shape of the concave portion is the same as the shape of the plurality of concave portions described with reference to FIGS. 1 and 2. In Example 2, a shape of a cross-section of the plurality of concave portions is a triangle, which is the same as the shape of the plurality of concave portions described with reference to FIGS. 4A and 4B. In Example 3, a shape of a cross-section of the plurality of concave portions is a quadrangle, which is the same as the shape of the plurality of concave portions described with reference to FIGS. 5A and 5B. In other embodiments of the present disclosure, different shapes or mixture of different shape and sizes of the plurality of concave portions may be arranged on the first or second surface.

Referring to FIG. 9, it is confirmed that as compared with the display device which does not include the plurality of concave portions according to the comparative example, the display device including the plurality of concave portions according to the examples has an excellent sound pressure level in the sound wave having the same frequency.

Specifically, it is confirmed that as compared with the display device which does not include the plurality of concave portions according to the comparative example, the display device including the plurality of concave portions according to various examples shows a high sound pressure level at all frequencies except for some frequencies in a high frequency area of 10000 Hz or higher. It is further confirmed that the difference of the sound pressure level is approximately 10 dB to 20 dB. When various examples including the plurality of concave portions are compared, it is confirmed that Example 1 including a plurality of concave portions having a circular cross-section shows a high sound pressure level at all frequencies except for some areas as compared with Examples 2 and 3 including a plurality of concave portions having a triangular or quadrangular cross-section. Therefore, it is understood that a display device including a plurality of concave portions having a circular cross-section has the highest sound pressure level. It is further confirmed that the display device including the plurality of concave portions has a higher sound pressure level than that of the display device which does not include the plurality of concave portions. This may be explained by a phenomenon that the sound resonates by the plurality of concave portions included in the electroactive layer and a phenomenon that the cross-sectional area of the surface of the electroactive layer is increased by the plurality of concave portions so that the blocking force of the electroactive layer is increased.

Figure 10:
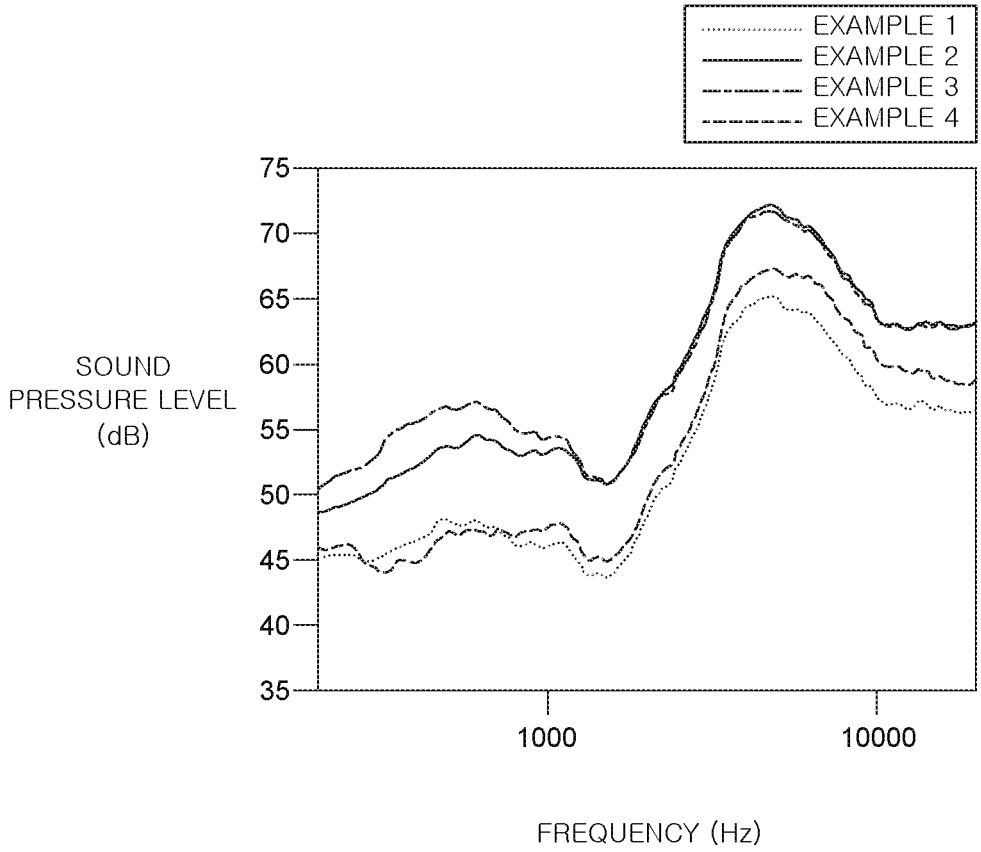
FIG. 10 is a graph for explaining a sound pressure level according to diameters of a plurality of concave portions of a film speaker which is included in a display device according to various examples of the present disclosure.

FIG. 10 is a graph for explaining a sound pressure level according to diameters of a plurality of concave portions of a film speaker which is included in a display device according to various example embodiments of the present disclosure.

FIG. 10 illustrates a sound pressure level of a display device in accordance with diameters of the plurality of concave portions. Display devices according to various examples have the same configuration except for various diameters of the plurality of concave portions. Specifically, the display devices according to Examples include an organic light emitting display panel, an electroactive layer, a first electrode, and a second electrode. A weight of the organic light emitting display panel is 80 g. The electroactive layer is formed using PVDF and a thickness thereof is 100 μm. The first electrode and the second electrode are formed using ITO, have a thickness of 300 nm and a resistance of 100 Ω/square. All the electroactive layer, the first electrode, and the second electrode are formed to be a rectangle having a size of 21 cm×29.7 cm. All the plurality of concave portions of the display devices of the examples is a semicircle and a dimeter d1 of the plurality of concave portions corresponds to two times the length of the depth d2 of the plurality of concave portions. The plurality of concave portions are formed only on the first surface of the electroactive layer, but is not formed on the second surface.

In Example 1, a diameter d1 of the plurality of concave portions is 0.5 cm and a distance d3 between the plurality of concave portions is 1 cm. In Example 2, a diameter d1 of the plurality of concave portions is 1 cm and a distance d3 between the plurality of concave portions is 1.5 cm. In Example 3, a diameter d1 of the plurality of concave portions is 3 cm and a distance d3 between the plurality of concave portions is 3.5 cm. In Example 4, a diameter d1 of the plurality of concave portions is 5 cm and a distance d3 between the plurality of concave portions is 5.5 cm.

Referring to FIG. 10, it is confirmed that the sound pressure level of Examples 2 and 3 is better than that of Examples 1 and 4. Specifically, it is confirmed that the sound pressure level of Examples 2 and 3 is approximately 5 dB higher than that of Examples 1 and 4 at all frequencies. The difference of sound pressure levels of Examples 2 and 3 is not significant at the same frequency. Further, the difference of sound pressure levels of Examples 1 and 4 is not significant at the same frequency. Therefore, it is confirmed that when the diameter d1 of the plurality of concave portions is 1 cm to 3 cm, the sound pressure level of the sound wave generated by the display device is improved.

The film speaker according to example embodiments of the present disclosure and the organic light emitting display device including the same will be described as follows:

A film speaker includes an electroactive layer having a first surface and a second surface opposite to the first surface, and including a plurality of concave portions; and a first electrode and a second electrode disposed on at least one of the first surface and the second surface of the electroactive layer.

According to another aspect of the present disclosure, a shape of a cross-section of each of the plurality of concave portions may be a semicircle.

According to another aspect of the present disclosure, diameters of the plurality of concave portions may be the same.

According to another aspect of the present disclosure, diameters of some of the plurality of concave portions may be different from diameters of the others of the plurality of concave portions.

According to another aspect of the present disclosure, the diameter of the plurality of concave portions may be about 1 cm or larger and about 3 cm or smaller.

According to another aspect of the present disclosure, a shape of a cross-section of each of the plurality of concave portions may be a polygon.

According to another aspect of the present disclosure, a shape of some of the plurality of concave portions may be different from a shape of the others of the plurality of concave portions.

According to another aspect of the present disclosure, a shape of a cross-section of some of the plurality of concave portions may be a polygon and a shape of a cross-section of the others of the plurality of concave portions may be a semicircle.

According to another aspect of the present disclosure, the plurality of concave portions may be disposed on at least one of the first surface and the second surface of the electroactive layer.

According to another aspect of the present disclosure, the plurality of concave portions may be disposed on one of the first surface and the second surface of the electroactive layer and a plurality of convex portions may be disposed on the other one of the first surface and the second surface of the electroactive layer.

According to another aspect of the present disclosure, when the plurality of concave portions are disposed on both the first surface and the second surface of the electroactive layer, some of the concave portions disposed on the first surface of the electroactive layer may be disposed to correspond to other of the concave portions disposed on the second surface of the electroactive layer.

According to another aspect of the present disclosure, when the plurality of concave portions are disposed on the first surface and the second surface of the electroactive layer, some of the concave portions disposed on the first surface of the electroactive layer and other of the concave portions disposed on the second surface of the electroactive layer may be alternately disposed.

According to another aspect of the present disclosure, the first electrode and the second electrode may be conformally disposed along the first surface and the second surface of the electroactive layer.

According to another aspect of the present disclosure, the first electrode and the second electrode may be made of a transparent conductive material.

A display device includes: a film speaker and a display panel disposed on a first surface of the film speaker to display images in which the film speaker includes an electroactive layer having a first surface and a second surface opposite to the first surface, and having a plurality of concave and convex structures disposed on at least one of the first surface and the second surface of the electroactive layer; and a first electrode and a second electrode which are disposed on at least one of the first surface and the second surface of the electroactive layer.

According to another aspect of the present disclosure, a shape of a cross-section of each of the plurality of concave and convex structures may be a semicircle.

According to another aspect of the present disclosure, a shape of a cross-section of each of the plurality of concave and convex structures may be a polygon.

According to another aspect of the present disclosure, the display device may further include: a backlight unit which is disposed to be adjacent to a second surface opposite to a first surface of the film speaker, the display panel being a liquid crystal display panel, and the electroactive layer may have the plurality of concave and convex structures only on a surface between the first surface and the second surface of the electroactive layer, the surface being adjacent to the second surface of the film speaker.

According to another aspect of the present disclosure, the display panel may be a light emitting display panel and the electroactive layer may have the plurality of concave and convex structures only on a surface between the first surface and the second surface of the electroactive layer, the surface being farther from the first surface of the film speaker than the second surface of the film speaker.

According to another aspect of the present disclosure, a film speaker may include an electroactive layer including a plurality of concave portions on a surface of the electroactive layer; and an electrode disposed on the surface, and inside the plurality of concave portions.

Although the example embodiments of the present disclosure have been described in detail with reference to the accompanying drawings, the present disclosure is not limited thereto and may be embodied in many different forms without departing from the technical concept of the present disclosure. Therefore, the example embodiments of the present disclosure are provided for illustrative purposes only but not intended to limit the technical concept of the present disclosure. The scope of the technical concept of the present disclosure is not limited thereto. Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A film speaker, comprising:

an electroactive layer having a first surface and a second surface opposite to the first surface, and including a plurality of concave portions that are recessed into the electroactive layer in at least one of the first surface or the second surface; and a first electrode and a second electrode disposed on at least one of the first surface and the second surface of the electroactive layer, wherein at least one of the first electrode and the second electrode is conformally disposed while forming curves along surfaces of the plurality of concave portions.

2. The film speaker according to claim 1, wherein a shape of a cross-section of each of the plurality of concave portions is a semicircle.

3. The film speaker according to claim 2, wherein diameters of the plurality of concave portions are the same.

4. The film speaker according to claim 2, wherein diameters of some of the plurality of concave portions are different from diameters of the others of the plurality of concave portions.

5. The film speaker according to claim 2, wherein a diameter of each of the plurality of concave portions is 1 cm or larger and 3 cm or smaller.

6. The film speaker according to claim 1, wherein a shape of a cross-section of each of the plurality of concave portions is a polygon.

7. The film speaker according to claim 6, wherein a shape of some of the plurality of concave portions is different from a shape of the others of the plurality of concave portions.

8. The film speaker according to claim 1, wherein a shape of a cross-section of some of the plurality of concave portions and a shape of a cross-section of the others of the plurality of concave portions are different, and wherein each shape of the cross section of the plurality of concave portions is one of a polygon and a semicircle.

9. The film speaker according to claim 1, wherein the plurality of concave portions are disposed on at least one of the first surface and the second surface of the electroactive layer.

10. The film speaker according to claim 9, wherein the plurality of concave portions are disposed on one of the first surface and the second surface of the electroactive layer, and a plurality of convex portions are disposed on the other one of the first surface and the second surface of the electroactive layer.

11. The film speaker according to claim 9, wherein when the plurality of concave portions are disposed on the first surface and the second surface of the electroactive layer, some of the plurality of concave portions disposed on the first surface of the electroactive layer are disposed to correspond to other of the plurality of concave portions disposed on the second surface of the electroactive layer.

12. The film speaker according to claim 9, wherein when the plurality of concave portions are disposed on the first surface and the second surface of the electroactive layer, some of the plurality of concave portions disposed on the first surface of the electroactive layer and other of the plurality of concave portions disposed on the second surface of the electroactive layer are alternately disposed.

13. The film speaker according to claim 1, wherein the first electrode and the second electrode are conformally disposed along the first surface and the second surface of the electroactive layer.

14. The film speaker according to claim 1, wherein the first electrode and the second electrode are made of a transparent conductive material.

15. A display device, comprising:

a film speaker; and a display panel disposed on a first surface of the film speaker to display images, wherein the film speaker includes:

an electroactive layer having a first surface and a second surface opposite to the first surface, and having a plurality of concave and convex structures that are recessed into the electroactive layer in at least one of the first surface and the second surface of the electroactive layer; and a first electrode and a second electrode conformally disposed on at least one of the first surface and the second surface of the electroactive layer.

16. The display device according to claim 15, wherein a shape of a cross-section of each of the plurality of concave and convex structures is a semicircle.

17. The display device according to claim 15, wherein a shape of a cross-section of each of the plurality of concave and convex structures is a polygon.

18. The display device according to claim 15, further comprising:

a backlight unit disposed adjacent to a second surface of the film speaker opposite to the first surface of the film speaker, wherein the display panel is a liquid crystal display panel and the electroactive layer has the plurality of concave and convex structures only on a surface between the first surface and the second surface of the electroactive layer, the surface being adjacent to the second surface of the film speaker.

19. The display device according to claim 15, wherein the display panel is a light emitting display panel and the electroactive layer has the plurality of concave and convex structures only on a surface between a first surface and the second surface of the electroactive layer, the surface being farther from the first surface of the film speaker than from a second surface of the film speaker.

20. A film speaker, comprising:

an electroactive layer including a plurality of concave portions that are recessed into the electroactive layer at a surface of the electroactive layer; and an electrode disposed on the surface of the electroactive layer, and inside the plurality of concave portions that are recessed, wherein the electrode is conformally disposed while forming curves along surfaces of the plurality of concave portions.

* * * * *